US009324262B2

(12) United States Patent
Kim et al.

(10) Patent No.: US 9,324,262 B2
(45) Date of Patent: Apr. 26, 2016

(54) PIXEL ARRAY STRUCTURE AND ORGANIC LIGHT EMITTING DISPLAY INCLUDING THE SAME

(71) Applicant: Samsung Display Co., Ltd., Yongin, Gyeonnggi-do (KR)

(72) Inventors: Min-Cheol Kim, Yongin (KR); In-Hwan Kim, Yongin (KR)

(73) Assignee: SAMSUNG DISPLAY CO., LTD., Yongin (KR)

( * ) Notice: Subject to any disclaimer, the term of this patent is extended or adjusted under 35 U.S.C. 154(b) by 466 days.

(21) Appl. No.: 13/671,432

(22) Filed: Nov. 7, 2012

(65) Prior Publication Data

US 2014/0043217 A1 Feb. 13, 2014

(30) Foreign Application Priority Data

Aug. 8, 2012 (KR) ..... 10-2012-0086774

(51) Int. Cl.
*G09G 3/32* (2006.01)

(52) U.S. Cl.
CPC ..... *G09G 3/3208* (2013.01); *G09G 3/3233* (2013.01); *G09G 2300/0452* (2013.01)

(58) Field of Classification Search
CPC ..... G02F 2201/52; H01L 27/3216; H01L 27/3211; H01L 3/2003; H01L 3/2074; G09G 2300/0452
USPC ..... 345/76
See application file for complete search history.

(56) References Cited

U.S. PATENT DOCUMENTS

| | | | | |
|---|---|---|---|---|
| 6,867,549 | B2 * | 3/2005 | Cok et al. | 315/169.3 |
| 7,248,314 | B2 * | 7/2007 | Yun | 349/108 |
| 7,268,792 | B2 * | 9/2007 | Lee | H04N 9/67 345/690 |
| 7,580,097 | B2 * | 8/2009 | Moon et al. | 349/113 |
| 7,876,341 | B2 | 1/2011 | Credelle et al. | |
| 2001/0054996 | A1 | 12/2001 | Naka et al. | |
| 2004/0046725 | A1 | 3/2004 | Lee | |
| 2004/0169807 | A1 | 9/2004 | Rho et al. | |
| 2004/0178974 | A1 | 9/2004 | Miller et al. | |
| 2004/0217694 | A1 * | 11/2004 | Cok et al. | 313/504 |
| 2005/0174363 | A1 * | 8/2005 | Brown Elliott | G09G 3/3607 345/694 |
| 2005/0225575 | A1 * | 10/2005 | Brown Elliott et al. | 345/694 |
| 2007/0216610 | A1 * | 9/2007 | Smith | 345/76 |
| 2008/0186325 | A1 * | 8/2008 | Higgins et al. | 345/592 |
| 2009/0051638 | A1 * | 2/2009 | Horiuchi et al. | 345/88 |
| 2010/0013848 | A1 * | 1/2010 | Hekstra et al. | 345/589 |
| 2010/0026704 | A1 * | 2/2010 | Han et al. | 345/590 |
| 2010/0207852 | A1 * | 8/2010 | Cok | 345/83 |

(Continued)

FOREIGN PATENT DOCUMENTS

| | | | |
|---|---|---|---|
| KR | 2002-0000479 | A | 1/2002 |
| KR | 2003-0086399 | A | 11/2003 |
| KR | 10-2004-0023241 | A | 3/2004 |

(Continued)

*Primary Examiner* — Matthew Yeung
(74) *Attorney, Agent, or Firm* — Knobbe Martens Olson & Bear LLP

(57) ABSTRACT

A pixel array structure of a display device, for example, an organic light emitting display device, includes a plurality of pixel units. In the pixel array structure, each of the pixel units includes four color pixels arranged in a lattice form, and a white sub-pixel positioned at the center of the pixel unit. The four pixels are disposed at a periphery of the pixel unit. In the pixel array structure, pixels are efficiently arranged in consideration of characteristics of the pixels.

20 Claims, 2 Drawing Sheets

(56) References Cited

U.S. PATENT DOCUMENTS

2010/0282945 A1* 11/2010 Yokogawa ..... H01L 27/14621 250/208.1
2011/0084990 A1 4/2011 An et al.

FOREIGN PATENT DOCUMENTS

KR 10-2005-0093778 A 9/2005
KR 10-2011-0026786 A 3/2011
KR 10-2011-0038321 A 4/2011

* cited by examiner

PIXEL ARRAY STRUCTURE AND ORGANIC LIGHT EMITTING DISPLAY INCLUDING THE SAME

CROSS-REFERENCE TO RELATED APPLICATION

This application claims priority to and the benefit of Korean Patent Application No. 10-2012-0086774, filed on Aug. 8, 2012, in the Korean Intellectual Property Office, the entire content of which is incorporated herein by reference.

BACKGROUND

1. Field

The present disclosure relates to a pixel array structure of a display device and an organic light emitting display including the same.

2. Discussion of the Related Technology

Organic light emitting display devices display images using organic light emitting diodes which are self-light emitting devices, have been spotlighted as the next-generation display due to excellent brightness and color purity.

In the organic light emitting display as described above, a plurality of pixels P are configured to use red sub-pixels R, green sub-pixels G, blue sub-pixels B, and white sub-pixels W to display various color images.

SUMMARY

An aspect of the present invention is to provide a pixel array structure in which pixels are efficiently arranged in consideration of characteristics of the pixels, and an organic light emitting display including the same.

One aspect provides a pixel array structure of a display device including a plurality of pixel units, wherein each of the pixel units may include four color pixels arranged in a lattice form; and a white sub-pixel positioned at a central portion of the pixel unit, wherein the color pixels are disposed at a periphery of the pixel unit.

In the foregoing structure, each of the color pixels may include a red sub-pixel, a green sub-pixel, and a blue sub-pixel.

The color pixels comprising a first color pixel and a second color pixel arranged in a row direction, wherein each of the first and second color pixels comprises a plurality of sub-pixels, wherein the sub-pixels of the first and second color pixels may be arranged symmetrically.

The color pixels comprising a first color pixel and a third color pixel arranged in a column direction, wherein each of the first and third color pixels comprises a plurality of sub-pixels, wherein the sub-pixels of the first and third color pixels may be arranged in the same order.

The sub-pixels may be arranged in a row direction.

The green sub-pixel may be arranged between the red sub-pixel and the blue sub-pixel.

The red sub-pixel may be positioned at one side of the green sub-pixel close to the white sub-pixel, and the blue sub-pixel may be positioned at the other side of the green sub-pixel distant from the white sub-pixel.

The red sub-pixel has a length shorter than those of other sub-pixels.

The color pixels comprising a first color pixel and a third color pixel arranged in a column direction, wherein each of the first and third color pixels comprises a plurality of sub-pixels, wherein at least a portion of the white sub-pixel may be positioned between the red sub-pixels of the first and third color pixels.

Each of the sub-pixels may include an organic light emitting diode.

An organic light emitting display device may comprise: a plurality of the groups; a scan driver unit configured to supply scan signals to pixels included in the pixel groups through scan lines; and a data driver unit configured to supply data signals to the pixels included in the pixel groups through data lines; wherein each of the pixel groups includes: four color pixels arranged in a lattice form, and a white sub-pixel positioned at a central portion of the pixel group, wherein the color pixels are disposed at a periphery of the pixel group.

In addition, each of the color pixels may include the red sub-pixel, the green sub-pixel, and the blue sub-pixel.

The color pixels comprising a first color pixel and a second color pixel arranged in a row direction, wherein each of the first and second color pixels comprises a plurality of sub-pixels, wherein the sub-pixels of the first and second color pixels may be arranged symmetrically.

The color pixels comprising a first color pixel and a third color pixel arranged in a column direction, wherein each of the first and third color pixels comprises a plurality of sub-pixels, wherein the sub-pixels of the first and third pixels may be arranged in the same order.

The sub-pixels may be arranged in a row direction.

The green sub-pixel may be arranged between the red sub-pixel and the blue sub-pixel.

The red sub-pixel may be positioned at one side of the green sub-pixel close to the white sub-pixel, and the blue sub-pixel may be positioned at the other side of the green sub-pixel distant from the white sub-pixel.

The red sub-pixel has a length shorter than those of other sub-pixels.

The color pixels comprising a first color pixel and a third color pixel arranged in a column direction, wherein each of the first and third color pixels comprises a plurality of sub-pixels, wherein at least a portion of the white sub-pixel may be positioned between the red sub-pixels of the first and third color pixels.

Each of the sub-pixels may include the organic light emitting diode.

BRIEF DESCRIPTION OF THE DRAWINGS

The accompanying drawings, together with the specification, illustrate embodiments of the present invention, and, together with the description, serve to explain the principles of the present invention.

DETAILED DESCRIPTION OF EMBODIMENT

Figure 1:
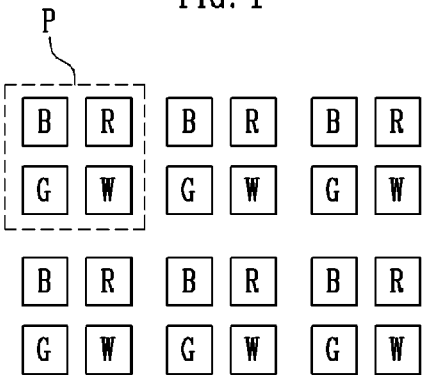
FIG. 1 is a view showing a pixel array structure.

Hereinafter, certain embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

Specific matters of other embodiments will be included in a detailed description and the accompanying drawings.

Advantages and features of the present invention and methods to achieve them will be elucidated from embodiments described below in detail with reference to the accompanying drawings. However, the present invention is not limited to embodiments disclosed below, but may be implemented in various different forms. In addition, in the following description, a case in which any part is connected to another part includes a case in which the parts are directly connected with each other and a case in which the parts are connected with each other, having another element interposed therebetween. Further, in the accompanying drawings, portions unrelated to the present invention will be omitted in order to make a description of the present invention obvious, and the same reference numerals will be used to describe similar portions throughout the present specification.

In an example of a pixel array shown in FIG. 1, each pixel P has been configured to include all of the red sub-pixels R, the green sub-pixels G, the blue sub-pixels B, and the white sub-pixels W, and areas of the sub-pixels R, G, B, and W have been set to be the same.

However, the foregoing configuration and arrangement of the sub pixels does not effectively reflect the characteristics (light emitting efficiency, brightness, or the like) of each sub-pixel R, G, B, and W and may cause problems such as the increase of the number of lines.

Hereinafter, a pixel array structure according to an embodiment of the present invention and an organic light display including the same will be described with reference to the embodiments of the present invention and the accompanying drawings.

Figure 2:
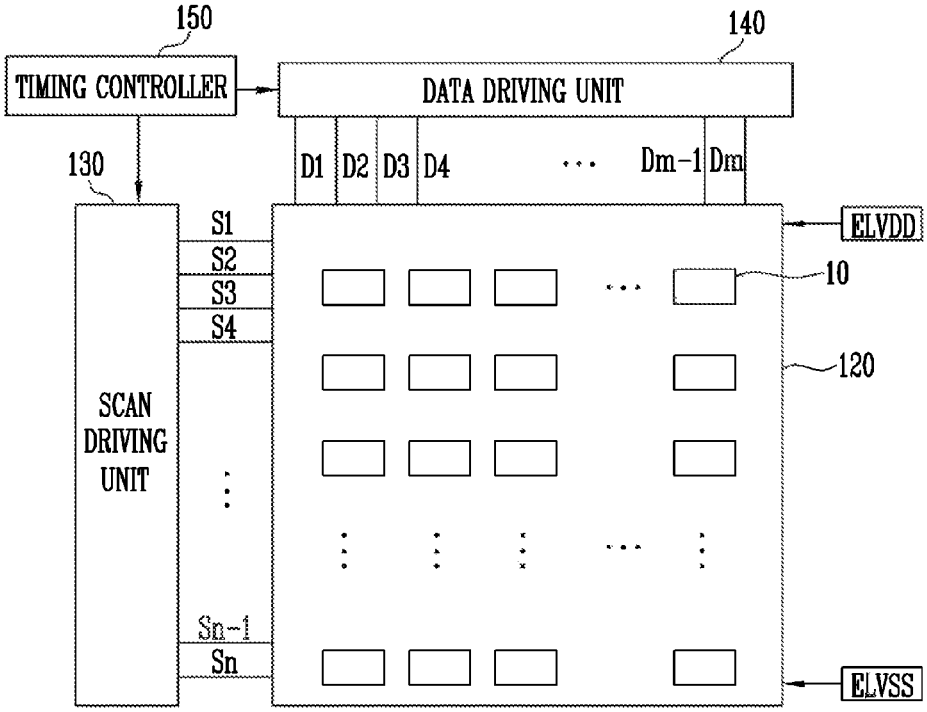
FIG. 2 is a view showing an organic light emitting display according to an embodiment of the present invention.

FIG. 2 is a view showing an organic light emitting display according to an embodiment of the present invention. Referring to FIG. 2, an organic light emitting display according to the embodiment of the present invention may include a pixel array 120 including a plurality of pixel groups or pixel units 10, a scan driving unit 130 supplying scan signals to the pixel groups 10 through scan lines S1 to Sn, a data driving unit 140 supplying data signals to the pixel groups 10 through data lines D1 to Dm, and a timing controlling unit 150 controlling the scan driving unit 130 and the data driving unit 140.

The pixel array 120 may include the plurality of pixel groups 10. In embodiments, these pixel groups 10 may be arranged in a lattice form. In addition, the pixel array 120 may be configured according to a pixel array structure to be described below, and the pixel groups 10 may include a plurality of sub-pixels.

The sub-pixels of the pixel groups 10 receiving a first voltage ELVDD and a second voltage ELVSS generate light corresponding to the data signal by current which flows from the first voltage ELVDD to the second voltage ELVSS via an organic light emitting diode.

The scan driving unit 130 generates the scan signals by a control of the timing controlling unit 150 and supplies the generated scan signals to the scan lines S1 to Sn. The data driving unit 140 generates the data signals by a control of the timing controlling unit 150 and supplies the generated data signals to the data lines D1 to Dm. When the scan signals are sequentially supplied to the scan lines S1 to Sn, the sub-pixels in the pixel groups 10 are sequentially selected in each line and the selected sub-pixels receives the data signals transferred from the data lines D1 to Dm.

Figure 3:
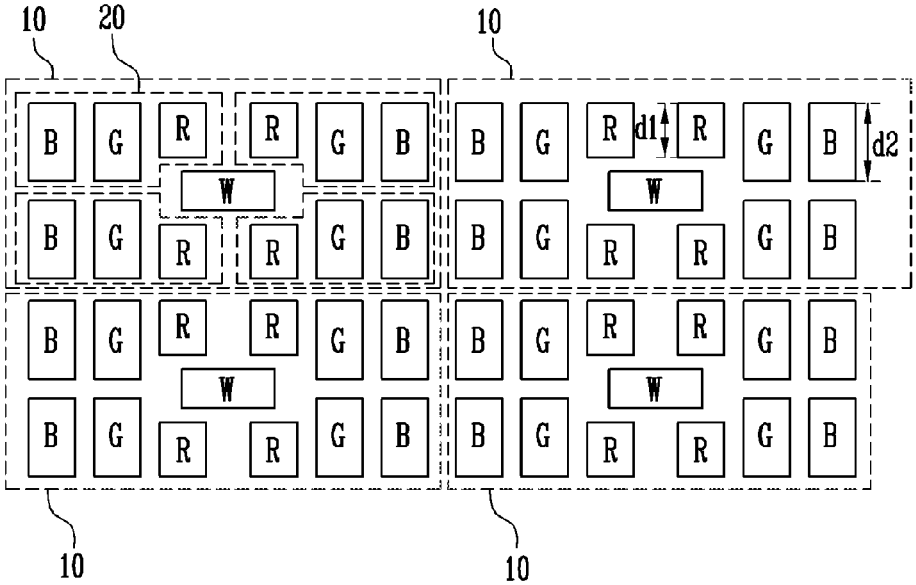
FIG. 3 is a view showing a pixel array structure according to the embodiment of the present invention.

FIG. 3 is a view showing a pixel array structure according to the embodiment of the present invention. Referring to FIG. 3, the pixel array structure according to the embodiment of the present invention may include a plurality of the pixel groups 10.

In this case, the pixel groups 10 may be arranged in the lattice form as shown in FIGS. 2 and 3. In the illustrated embodiments, the pixel units 10 are arranged in rows and columns.

In embodiments, the pixel group 10 may include four color pixels 20 and one white sub-pixel W. In embodiments, the white sub-pixel W may be positioned at the center of the pixel group 10 and the four pixels 20 may be positional at the periphery of the pixel group 10 or may be positioned around the white sub-pixel W. In the illustrated embodiment, one white sub-pixels W and four pixels 20 form a pixel group or unit 10, but the present invention is not limited thereto.

In embodiments, the pixel unit 10 includes first to fourth color pixels 20. The first and second pixels 20 are arranged in a row (along a row direction), and the third and fourth pixels 20 are arranged in another row (along the row direction). The first and third pixels 20 are arranged in a column (along a column direction), and the second and fourth pixels 20 are arranged in another column (along the column direction).

Each of the pixels 20 may include a red sub-pixel R, a green sub-pixel G, and a blue sub-pixel B. In embodiments, each of the sub-pixels R, G, and B may be arranged in a row direction.

Further, the sub-pixels R, G, and B included in each of the first and second pixels of the pixel group 10 may be arranged symmetrically with respect to an imaginary line in a column direction. Specifically, describing the first and second pixels 20 positioned at a left upper position and a right upper position with respect to the location of the white sub-pixel W in FIG. 3, respectively, the sub-pixels R, G, and B included in the first pixel 20 positioned at the left upper position are arranged in the order of the blue sub-pixel B, the green sub-pixel G, and the red sub-pixel R, and the sub-pixels R, G, B included in the second pixel 20 positioned at the right upper position are arranged in the order opposite to the above-mentioned order, that is, in the order of the red sub-pixel R, the green sub-pixel G, and the blue sub-pixel B.

Further, the sub-pixels R, G, and B included in each of the first and third pixels may be arranged in the same order. Specifically describing the first and third pixels 20 positioned at the left upper position and the left lower position with respect to the white sub-pixel W in FIG. 3, respectively, the sub-pixels R, G, B included in the first pixel 20 positioned at the left upper position are arranged in order of the blue sub-pixel B, the green sub-pixel G, and the red sub-pixel R, and the sub-pixels R, G, B included in the third pixel 20 positioned at the left lower position are arranged in the same order as the above-mentioned order, in the order of the blue sub-pixel B, the green sub-pixel G, and the red sub-pixel R.

In embodiments, the red sub-pixels R can be arranged in a column, the green sub-pixels G can be arranged in another column, and the blue sub-pixels B may be arranged in the other column.

In embodiments, in each color pixel, the green sub-pixel G, which is a pixel determining a recognition resolution, may be positioned between the red sub-pixel and the blue sub-pixel.

Further, as seen in the pixel array structure shown in FIG. 3, the red sub-pixel R may be positioned at one side of the green sub-pixel G close to the white sub-pixel W, and the blue sub-pixel B may be positioned at the other side of the green sub-pixel G distant from the white sub-pixel W.

In addition, in order to secure a space where the white sub-pixel W is to be positioned at a central portion of the pixel 20, a length d1 of the red sub-pixel R may be set to be shorter than a length d2 of the other sub-pixels G and B. Therefore, the white sub-pixel W may be positioned in a space formed by the shortened length d1 of the red sub-pixel R.

The red sub-pixel R has excellent light emitting efficiency and brightness greater than those of the green sub-pixel G or the blue sub-pixel when the same amount of current is supplied thereto. Thus, even though an area of the red sub-pixel is smaller than the other sub-pixels G and B, visibility is not deteriorated.

In embodiments, the area of the white sub-pixel W may be increased by decreasing the area of the red sub-pixel R having the excellent light emitting efficiency. Thus, the number of white sub-pixels W may be decreased as compared with the above-mentioned example of the pixel array shown in FIG. 1. Therefore, the entire number of data lines may be decreased.

Figure 4:
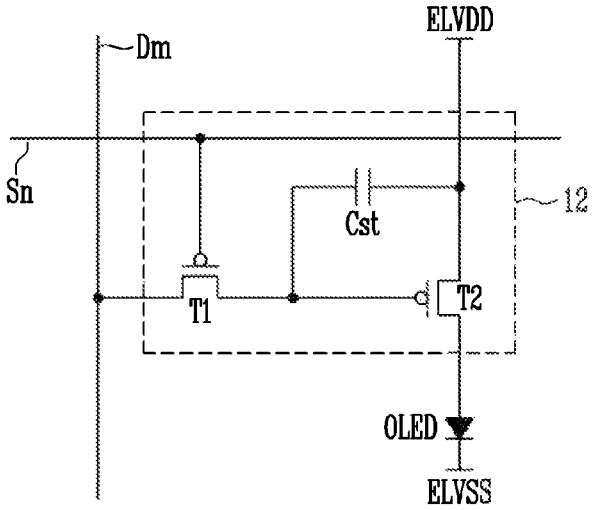
FIG. 4 is a view showing an example of a sub-pixel.

FIG. 4 is a view showing an example of a sub-pixel. Particularly, in FIG. 4, a sub-pixel connected to an n-th scan line Sn and an m-th data line Dm will be shown for convenience of explanation.

Referring to FIG. 2, the each of sub-pixels R, G, B, and W includes the organic light emitting diode (OLED) and the pixel circuit 12 connected to the data lines Dm and the scan lines Sn to control the OLED. An anode electrode of the OLED is connected to the pixel circuit 12, and a cathode electrode thereof is connected to a second voltage ELVSS. The organic light emitting diode (OLED) as described above generates light having a predetermined brightness corresponding to current supplied from the pixel circuit 12.

The sub-pixels may be classified into the red sub-pixel R, the green sub-pixel G, the blue sub-pixel, B and the white sub-pixel W depending on the light generated in the OLED.

The pixel circuit 12 controls an amount of current supplied to the organic light emitting diode (OLED), corresponding to the data signal supplied to the data line Dm when the scan signal is supplied to the scan line Sn. To this end, the pixel circuit 12 includes a second transistor T2 connected between a first voltage ELVDD and the OLED, a first transistor T1 connected between the second transistor and the data and scan lines Dm and Sn, and a storage capacitor Cst connected between a gate electrode of the second transistor T2 and the first electrode.

The gate electrode of the first transistor T1 is connected to the scan line Sn, and the first electrode thereof is connected to the data line Dm. In addition, the second electrode of the first transistor T1 is connected to one side terminal of the storage capacitor Cst.

Here, the first electrode is set to any one of a source electrode and a drain electrode, and the second electrode is set to an electrode different from the first electrode. For example, when the first electrode is set to the source electrode, the second electrode is set to the drain electrode.

The first transistor T1 connected to the scan line Sn and the data line Dm is turned on when it has the scan signal supplied from the scan line Sn, thereby supplying the data signal supplied from the data line Dm to the storage capacitor Cst. In this case, the storage capacitor Cst is charged with voltage corresponding to the data signal.

The gate electrode of the second transistor T2 is connected to one side terminal of the storage capacitor Cst, and the first electrode thereof is connected to the other side terminal of the storage capacitor Cst and the first voltage ELVDD. Further, the second electrode of the second transistor T2 is connected to the anode electrode of the organic light diode (OLED).

The second transistor T2 as described above controls an amount of current flowing from the first voltage ELVDD to the second voltage ELVSS via the organic light emitting diode (OLED), corresponding to a voltage value stored in the storage capacitor (Cst). In this case, the organic light emitting diode (OLED) generates light corresponding to the amount of current supplied from the second transistor T2.

The pixel structure of FIG. 4 as described above is only an example of the present invention. Therefore, structures of each of the sub-pixels R, G, B, and W of the present invention are not limited to the above-mentioned pixel structure. Actually, the pixel circuit 12 may have a circuit structure capable of supplying the current to the organic light emitting diode (OLED) and have any one of well-known various structures.

As set forth above, according to the embodiments of the present invention, it is possible to provide a pixel array structure in which pixels are efficiently arranged in consideration of characteristics of the pixels, and an organic light emitting display including the same.

While the present invention has been described in connection with certain embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel array structure of a display device comprising a plurality of pixel units, wherein each of the pixel units comprises four color pixels and a white sub-pixel, wherein the four color pixels do not overlap each other, wherein each of the four color pixels does not comprise a white sub-pixel, and comprises a plurality of color sub-pixels, and one of the plurality of color sub-pixels is a smallest color sub-pixel, wherein the white sub-pixel is surrounded by the four smallest color sub-pixels of the four color pixels and immediately neighbors each of the four smallest color sub-pixels, wherein the four smallest color sub-pixels of the four color pixels are of the same color.

2. The pixel array structure according to the claim 1, wherein the four color pixels comprising a first color pixel and a second color pixel arranged in a column direction, wherein each of the first and second color pixels comprises a plurality of sub-pixels, wherein the sub-pixels of the first and second color pixels are arranged in the same order.

3. The pixel array structure according to the claim 1, wherein the four color pixels comprising a first color pixel and a second color pixel arranged in a row direction, wherein each of the first and second color pixels comprises a plurality of sub-pixels, wherein the sub-pixels of the first and second color pixels are arranged symmetrically.

4. A pixel array structure of a display device comprising a plurality of pixel units, wherein each of the pixel units comprises four color pixels and a white sub-pixel, wherein the four color pixels do not overlap each other, wherein each of the four color pixels does not comprise a white sub-pixel and comprises a plurality of color sub-pixels, which comprise a red sub-pixel, a green sub-pixel, and a blue sub-pixel, and one of the plurality of color sub-pixels is a smallest color sub-pixel, wherein the white sub-pixel is surrounded by the four smallest color sub-pixels of the four color pixels and immediately neighbors each of the four smallest color sub-pixels, wherein the four smallest color sub-pixels of the four color pixels are of the same color.

5. The pixel array structure according to the claim 4, wherein the color sub-pixels are arranged in a row direction.

6. The pixel array structure according to the claim 5, wherein the green sub-pixel is arranged between the red sub-pixel and the blue sub-pixel.

7. The pixel array structure according to the claim 6, wherein the red sub-pixel is positioned at one side of the green sub-pixel close to the white sub-pixel, and the blue sub-pixel is positioned at the other side of the green sub-pixel distant from the white sub-pixel.

8. The pixel array structure according to the claim 7, wherein the red sub-pixel is the smallest color sub-pixel.

9. The pixel array structure according to the claim 8, wherein the four color pixels comprising a first color pixel and a third color pixel arranged in a column direction, wherein each of the first and third color pixels comprises a plurality of sub-pixels, wherein at least a portion of the white sub-pixel is positioned between the red sub-pixels of the first and third color pixels.

10. The pixel array structure according to the claim 4, wherein each of the sub-pixels comprises an organic light emitting diode.

11. An organic light emitting display device comprising:

a plurality of pixel groups;

a scan driver unit configured to supply scan signals to pixels included in the pixel groups through scan lines; and a data driver unit configured to supply data signals to the pixels included in the pixel groups through data lines;

wherein each of the pixel groups includes four color pixels, and a white sub-pixel, wherein the four color pixels do not overlap each other, wherein each of the four color pixels does not comprise a white sub-pixel and comprises a plurality of color sub-pixels, and one of the plurality of color sub-pixels is a smallest color sub-pixel, wherein the white sub-pixel is surrounded by the four smallest color sub pixels and immediately neighbors each of the four smallest color sub-pixels, wherein the four smallest color sub-pixels of the four color pixels are of the same color.

12. The organic light emitting display according to the claim 11, wherein the plurality of color sub-pixels comprise a red sub-pixel, a green sub-pixel, and a blue sub-pixel.

13. The organic light emitting display according to the claim 11, wherein the four color pixels comprising a first color pixel and a second color pixel arranged in a row direction, wherein each of the first and second color pixels comprises a plurality of sub-pixels, wherein the sub-pixels of the first and second color pixels are arranged symmetrically.

14. The organic light emitting display according to the claim 11, wherein the four color pixels comprising first and second color pixels which are arranged in a column direction, wherein each of the first and second color pixels comprises a plurality of sub-pixels, wherein the sub-pixels of the first and second color pixels are arranged in the same order.

15. The organic light emitting display according to the claim 12, wherein the sub-pixels are arranged in a row direction.

16. The organic light emitting display according to the claim 15, wherein the green sub-pixel are arranged between the red sub-pixel and the blue sub-pixel.

17. The organic light emitting display according to the claim 16, wherein the red sub-pixel is positioned at one side of the green sub-pixel close to the white sub-pixel, and the blue sub-pixel is positioned at the other side of the green sub-pixel distant from the white sub-pixel.

18. The organic light emitting display according to the claim 17, wherein the red sub-pixel is the smallest color sub-pixel.

19. The organic light emitting display according to the claim 18, wherein the four color pixels comprising first and third color pixels which are arranged in a column direction, wherein each of the first and third color pixels comprises a plurality of sub-pixels, wherein at least a portion of the white sub-pixel is positioned between the red sub-pixels of the first and third color pixels.

20. The organic light emitting display according to the claim 12, wherein each of the sub-pixels comprises an organic light emitting diode.

* * * * *